United States Patent [19]

Gagon

[11] 4,342,639

[45] Aug. 3, 1982

[54] PROCESS TO SEPARATE BITUMINOUS MATERIAL FROM SAND (TAR SANDS)

[76] Inventor: Hugh W. Gagon, 3350 Florita Ave., West Valley City, Utah 84115

[21] Appl. No.: 171,137

[22] Filed: Jul. 22, 1980

[51] Int. Cl.[3] ..... C10G 1/04

[52] U.S. Cl. ..... 208/11 LE; 208/353; 208/366

[58] Field of Search ..... 208/11 LE, 353, 361, 208/366, 352; 203/25

[56] References Cited

U.S. PATENT DOCUMENTS

| | | | |
|---|---|---|---|
| 2,029,501 | 2/1936 | Page | 208/353 |
| 2,723,940 | 11/1955 | Fenske et al. | 208/366 |
| 2,895,546 | 7/1959 | Sadtler | 203/25 |
| 3,131,141 | 4/1964 | West | 208/11 LE |
| 3,856,474 | 12/1974 | Pittman et al. | 208/11 LE |
| 3,884,292 | 5/1975 | Pessolano et al. | 165/39 |
| 4,055,480 | 10/1977 | Smith et al. | 208/11 LE |
| 4,057,485 | 11/1977 | Blarne | 208/11 LE |
| 4,098,648 | 7/1978 | Kraemer et al. | 208/11 LE |
| 4,217,202 | 8/1980 | Paraskos et al. | 208/11 LE |

FOREIGN PATENT DOCUMENTS

| | | | |
|---|---|---|---|
| 574930 | 4/1959 | Canada | 208/352 |
| 638633 | 3/1962 | Canada | 208/11 LE |
| 639713 | 4/1962 | Canada | 208/11 LE |
| 164525 | 3/1920 | United Kingdom | 203/25 |
| 1527269 | 10/1978 | United Kingdom | 208/11LE |

*Primary Examiner*—Delbert E. Gantz
*Assistant Examiner*—Joseph A. Boska
*Attorney, Agent, or Firm*—Terry M. Crellin; B. Deon Criddle

[57] ABSTRACT

Bituminous sand such as oil sand or tar sand is mixed with a halogenated organic solvent which has a density greater than that of water at the same temperature. The slurry is continuously transferred to a conveyor system which is at least partially submerged in water, with the slurry being fed onto the portion of the conveyor which is submerged. As the sands move through the water on the conveyor, the organic solvent containing the bituminous material separates from the sand and forms a separate phase beneath the water. The sands ultimately move upwardly on the conveyor through the surface of the water. The organic phase is removed from beneath the water surface and the halogenated solvent is flashed therefrom in a flash evaporator chamber. Solvent vapors are withdrawn from the evaporator chamber by a compressor, and the compressed vapors are introduced into a condenser chamber. A heat exchange medium is continuously circulated between the condenser and evaporator chambers, with heat being transferred from the heat exchange medium in the evaporator and back to the heat exchange medium in the condenser. Bituminous organic material is withdrawn from the evaporator chamber and condensed solvent is recovered from the condenser. Preferably, the heat exchange means comprises a plurality of heat pipes, with mutually respective end portions of the heat pipes extending into the condenser chamber and the other end portions extending into the evaporator chamber.

9 Claims, 9 Drawing Figures

PROCESS TO SEPARATE BITUMINOUS MATERIAL FROM SAND (TAR SANDS)

BACKGROUND OF THE INVENTION

1. Field:

This invention relates to processes for recovering bituminous organic material from tars sands or oil sands, and, more particularly, to processes utilizing an organic solvent to dissolve the bituminous material from the sands.

2. State of the Art:

Large deposits of oil sands or tar sands are found in various parts of the world, in particular in Canada, the United States of American, Venezuela, Russia, and Malagasy. Various attempts have been made in the past to recover the bituminous organic material from tar sands and oil sands. Retorting and other thermal processes are uneconomical due to the large quantity of heat consumed without any effective and efficient recovery thereof.

Processes utilizing water and a hydrocarbon diluent, such as kerosene, have been disclosed. For example, see U.S. Pat. Nos. 2,453,060; 2,825,677; and 3,509,037. Unfortunately, such processes utilize large amounts of heat and water. In addition, these processes are expensive and can cause serious environmental problems due to polluted water and sand which are produced in copious amounts.

Solvent extraction of bituminous organic material from tar sands or oil sands has also been proposed. For example, see U.S. Pat. Nos. 1,514,113; 2,453,633; 2,596,793; 3,050,289; 3,079,326; 3,131,141; 3,392,105; 3,475,318; 3,503,868; 3,509,037; 4,029,568; 4,046,668; 4,046,669; 4,057,485; and 4,110,194. Unfortunately, low yields, high energy consumption, loss of solvents, and environmental problems including dirty spent sands containing both solvent and bituminous material has hindered the development the solvent extraction processes.

3. Objectives:

A principal objective of the present invention is to provide an efficient solvent extraction process for high yields of bituminous organic material from tar sands or oil sands with a low solvent loss. Another objective of the invention is to develop a process requiring a minimum of energy consumption due to the relatively mild conditions used in recovering the organic solvent from the bituminous organic material and the effective recovery and reuse of heat values. A further objective of the invention is to provide a process which uses only very small amounts of water. An even further objective of the invention is to provide a process which is environmentally clean, i.e., can be operated without polluting the ambient air and water, and produces a clean sand which can be further processed to recover mineral values therefrom or disposed of without causing a pollution problem. A still further object of the invention is to provide a process for efficiently recovering the bituminous organic material in a form which can be used for many purposes without further processing or treatment.

SUMMARY OF THE INVENTION

The above objectives are achieved in accordance with the present invention by providing a novel method of recovering bituminous organic material from tar sands or oil sands. The sands containing the bituminous organic material are mixed with a halogenated organic solvent which is substantially immiscible with water and has a density greater than that of water at the same temperature. The organic solvent is also capable of dissolving the bituminous organic material contained in the sands. A slurry is thereby produced comprising solid sand particles suspended in a solution of bituminous organic material dissolved in the halogenated organic solvent.

The resulting slurry is continuously transferred to a conveyor system which is at least partially submerged in water, with the slurry being fed onto the portion of the conveyor which is submerged in the water. The sands in the slurry are preferentially wetted by water, and the organic solvent solution, which is essentially immiscible in the water phase, separates from the particulate sands and forms a separate phase beneath the water. The movement of the particulate sands on the conveyor enhances the separation of the organic solution from the sand particles, so that the sand particles become essentially completely wetted by the water phase. The particulate sands ultimately move upwardly on the conveyor through the surface of the water and are transferred to storage. The sands, which emerge from the water on the conveyor, are wetted essentially only by water and contain essentially no organic solvent. Such sands are readily available for further processing to recover other mineral values therefrom, or the sand can be used as a conventional clean sand aggregate. If further utilization of the sand is not economically feasible, the clean sands can be disposed of without creating a detrimental pollution problem.

The organic phase comprising the solution of bituminous organic material dissolved in the halogenated organic solvent is recovered from beneath the water phase. Preferably the organic solvents used in the present process have relatively low boiling points, low specific heats and low heats of vaporization. Even though such solvents are quite volatile (even at atmospheric conditions which are used in the mixing and sand separation steps of this process) losses of the organic solvent has been found to be minimal due to the water cap which is maintained over the solvent solution during the sand separation step. Further, the mixing of the tar sands or oil sands with the organic solvent is advantageously accomplished in a mixing vessel in which a water cap is maintained on the top of the organic phase in the mixing vessel.

Preferably, the solution of bituminous material dissolved in the organic solvent which is recovered from beneath the water phase is subjected to flash evaporation to separate the bituminous material from the organic solvent. The solution is introduced into a flash evaporator chamber, and solvent vapors are removed from the evaporator chamber by a compressor. The vapors are compressed and then introduced into a condenser chamber wherein the vapors are condensed and the liquid, organic solvent is recovered for reuse in the process. The halogenated organic solvents have low heats of vaporization, and low specific heats so that minimum heat is required in flashing the solvents in the flash evaporator. Further, solvents having relatively low boiling points can be used thereby allowing use of low grade heat energy in the process.

Further efficiency is achieved by continuously circulating a heat exchange medium between the condenser chamber and the flash evaporator chamber. Heat is transferred from the heat exchanger medium in the flash evaporator chamber to aid in the flash evaporation of the organic solvent therein. Heat is recovered and transferred to the heat transfer medium in the condenser chamber by the condensing vapors Bituminous organic material is withdrawn from the evaporator chamber, and it has been found that the bituminous material can unexpectedly be used in many applications without further treatment or refinement. The bituminous material has been found to be equivalent to or better than gilsonite in those uses for which gilsonite is presently in demand, such as in printers ink, pipeline insulation, varnishes and paints, concrete foundation sealer, black top paving sealer. The bituminous material has also been found to provide excellent coatings for parking terraces, foundations, bridges, wood surfaces of any kind and underseal coatings for automobiles, locomotives, and other equipment where rust inhibitors are very important. In addition, of course, the bituminous material can be refined for use as a fuel and petrochemical feedstocks.

Additional objects and features of the invention will become apparent from the following detailed description, taken together with the accompanying drawings.

THE DRAWINGS

Particular embodiments of the present invention representing the best mode presently contemplated of carrying out the invention is illustrated in the accompanying drawings, in which.

DETAILED DESCRIPTION OF THE PREFERRED EMBODIMENTS

Figure 1:
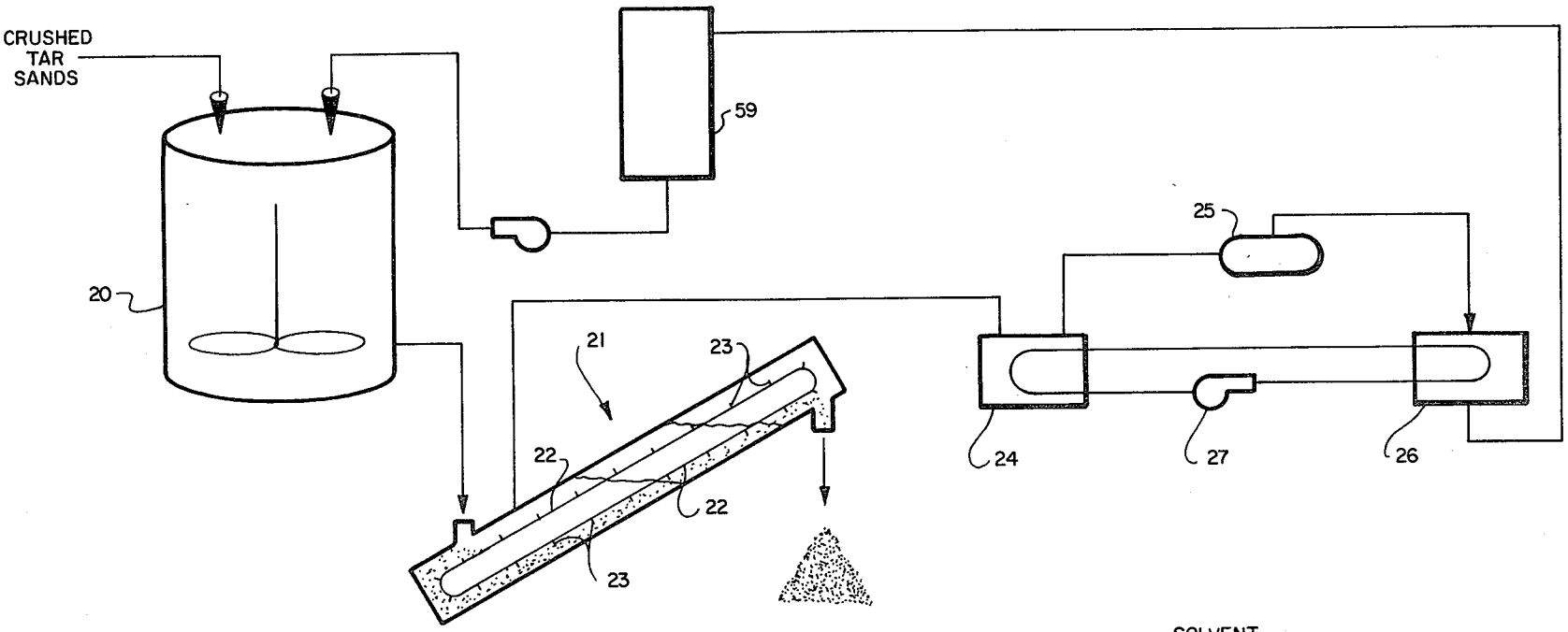
FIG. 1 is a flowsheet of the process of this invention.

A general flowsheet of the process of this invention is shown in FIG. 1. In the first step of the process, oil sand or tar sand is mixed with a halogenated organic solvent. The halogenated, organic solvent dissolves the bituminous material in the sands to produce a slurry of the particulate sands suspended in the organic solvent solution containing the dissolved bituminous material. The mixing is preferably accomplished in a mixing vessel 20 having appropriate means for agitating the contents thereof so as to produce a substantially uniformly dispersed slurry.

The halogenated organic solvent employed has a density greater than that of water and is essentially immiscible in water. The solvent is also capable of dissolving the bituminous organic material in the oil sands or tar sands. The halogenated organic solvent is preferably selected from the group consisting of methylene chloride, trichloromonofluoromethane, chloroform, carbon tetrachloride, bromotrichloromethane, dibromotetrafluoromethane, trichloroethane, trichloroethylene, tetrachloroethane, trichlorotrifluoroethane, dibromotetrafluoroethane, dichlorotrifluoroethane, and tetrachloroethylene.

The temperatures and pressures employed in the mixing vessel are not per se critical. Atmospheric pressure and temperatures are preferred as being most cost efficient generally. Subatmospheric pressures would generally be avoided as being unnecessary and costly. Pressures greater than atmospheric could be employed to minimize solvent evaporation losses or for operation at temperatures above the normal atmospheric boiling point of the solvent which is being used. Atmospheric temperatures within the range of about 50° to 300° F. are preferably employed, with the proviso that the temperature is less than the boiling point of the solvent at the pressure which is being used. It is pointed out, however, that one of the benefits of the present invention is its use of mild operating conditions to avoid unnecessary energy requirements in operating the process.

The solvents used in the present process are generally highly volatile which aids in the efficient separation of the solvent and bituminous organic material as described hereinafter. To prevent loss of solvent vapors from the mixing vessel, a water cap is maintained in the vessel. The water cap forms a separate phase on top of the solvent-sand slurry and prevents volatilization of the solvent.

The slurry is withdrawn from the mixing vessel 20 and continuously transferred onto a conveyor system 21 which is at least partially submerged in water, with the slurry being fed onto the portion of the conveyor which is submerged in the water. As illustrated diagrammatically in FIG. 1, the conveyor can be of the inclined drag line type comprising an endless belt 22 which travels about end pulleys in an elongated circuitous loop within a housing containing the belt 22. A plurality of paddles or cleats 23 are attached to the belt 22 in longitudinaly spaced positions along the belt 22. Sand is moved upwardly along the inclined housing by the cleats 23. Other conveyor systems which have been found to be useful in the present invention will be described hereinafter.

Generally, the sands are moved through the water by the conveyor means and the solution of bituminous organic material dissolved in the halogenated organic solvent quickly separates from the particulate sands and forms a separate organic phase beneath the water phase. The organic phase comprising the halogenated solvent is heavier than the water and is essentially immiscible in the water. In addition, the sands are preferentially wetted by the water phase. Although not intending to be limited to any particular theory, it is believed that the rapid separation of the organic phase and the sands is due to the preferential wetting of the sands with the water and the immiscible heavier nature of the organic solvent phase. Irrespective of any theory, it has been found that the organic phase quickly and effectively separates from the sand and forms a separate phase beneath the water phase. The particulate sands continue to move upwardly through the water and emerge from the surface of the water so that the sand particles are wetted essentially only by water and contain essentially no organic solvent.

The sands emerging from the water phase in the conveyor mechanism 21 will generally be essentially cleaned of any bituminous material if an adequate ratio of solvent to tar sands or oil sands is utilized in the mixing vessel and if residence time in the mixing vessel is adequate for the solvent to dissolve the bituminous material from the sands. Generally, the solvent to tar sands or oil sands ratio will be about 30 to 50 gallons of solvent per ton of tar sands or oil sands. The residence time in the mixing vessel is generally between about one to ten minutes. Operation with somewhat less solvent per ton of sands and with less residence time in the mixer is feasible; however, the sands emerging from the surface of the water in the conveyor system may contain some residual bituminous material thereon. In such cases, a cascade type separation may be used, wherein the water wetted sands is mixed with additional solvent and then introduced into a second conveyor system (not shown in drawing) similar to the conveyor system 23 wherein the solvent phase is separated from the sands. The temperature of the water in the conveyor system 21 will generally be maintained about the same as the temperature of the slurry which is being introduced thereinto. The conveyor system preferably operates at atmospheric pressure.

The organic phase containing the bituminous material dissolved in the halogenated organic solvent is recovered from beneath the water phase in the conveyor system 21 and preferably treated to separate the organic solvent from the bituminous material. When a cascade type separation is used, solvent is made to move countercurrently through the cascade system, with the solvent being withdrawn from the initial unit of the cascade system being recovered and treated to separate the organic solvent from the bituminous material. As illustrated, the recovered organic phase containing the bituminous material is introduced into a flash evaporator chamber 24 wherein the organic solvent is flashed from the bituminous material. The pressure in the evaporator chamber is maintained at a value less than the pressure of the organic solution which is being introduced thereinto by withdrawing vapors of the organic solvent from the evaporator chamber 24 by a compressor 25. Generally, the evaporator chamber 24 will operate at a subatmospheric pressure or vacuum of about 10 to 20 inches of water. The vapors are compressed by the compressor 25 to between about atmospheric pressure and 50 pounds per squre inch absolute, and the compressed vapors are introduced into a condenser chamber 26.

The vapors in the condenser chamber 26 are brought into heat exchanging relation with a heat exchange medium, whereby the vapors are condensed. As illustrated in FIG. 1, a heat exchange medium, such as water, is continuously circulated by pump 27 through a closed loop which extends from the evaporator chamber 24 to the condenser chamber 26. As the heat exchange medium circulates through the portion of the closed loop within the condenser chamber 26, heat is transferred to the heat exchange medium by the condensing vapors. The heated heat exchange medium then circulates through the portion of the closed loop in the evaporator chamber 24, whereby heat is transferred from the heat exchange medium to aid in the flash evaporation of the organic solvent therein. As a result, the heat exchange medium is cooled in the evaporator chamber 24, and the cooled heat exchange medium is then recirculated to the portion of the closed loop in the condenser chamber 26. By utilizing the heat liberated by the condensing vapors in the condenser chamber 26 to provide at least a portion of the heat required in flashing the solvent in the evaporator chamber 24, little if any additional heat is needed. The work input by the compressor usually provides all the equivalent heat necessary in the system; however, as shown, a supplemental heating coil can be positioned in the evaporator chamber 24 through which a heated medium can be passed if necessary. A supplemental cooling coil can also be positioned in the condenser chamber 26 through which a cooling medium can be passed to aid in the condensation of the vapors in the condenser chamber 26 if necessary. Alternatively, a heating unit and cooling unit could be provided on the closed loop through which the heating medium is circulated by the pump 27. The heating unit would add additional heat to the heat exchange medium flowing from the condenser chamber 26 to the evaporator chamber 24, and the cooling unit would cool the heat exchange medium moving in the opposite direction of the closed loop.

The temperatures employed in the evaporator chamber 24 and the condenser chamber 26 are dependent upon the boiling point of the solvent which is used. The solvents have relatively low boiling points and are highly volatile, i.e., have relatively low heats of vaporization. The relatively low tempertures and the low heats of vaporization contributes to the high efficiency which is achieved in the separation of the solvent from the bituminous material. In addition to the efficiency achieved by the heat exchange system in the evaporator chamber 24 and condenser chamber 26, the low heats of vaporization of the solvents of this invention minimizes the amount of heat required in flashing the solvents in the evaporator chamber 24. By virtue of the low boiling temperatures of the solvents which are used, heating requirements are further reduced and low grade heat sources can be employed. In addition to the above benefits, the solvents of this invention are inflamable and, thus, do not create a fire hazard. Further, the solvents are completely inert with respect to the bituminous material which is extracted from the tar sands or oil sands, and the recovered solvent can be reused over and over without any effect on its chemical and physical properties, including its nonflamability. The condensed solvent which accumulate in the condenser chamber is withdrawn therefrom and recycled. A solvent holding tank 55 (FIG. 1) is advantaeously employed to store recovered solvent prior to its reuse in the process.

The bituminous materials, which accumulate in the evaporator chamber 24 as the solvent is flashed, forms a liquid phase at the bottom of the evaporator chamber 24. The bituminous material is withdrawn from the evaporator chamber 24, and as mentioned hereinbefore, the recovered bituminous material can be used in many applications and uses without further treatment or refinement. In addition, the bituminous material can be further refined for use as a fuel and petrochemical feedstock.

Figure 2:
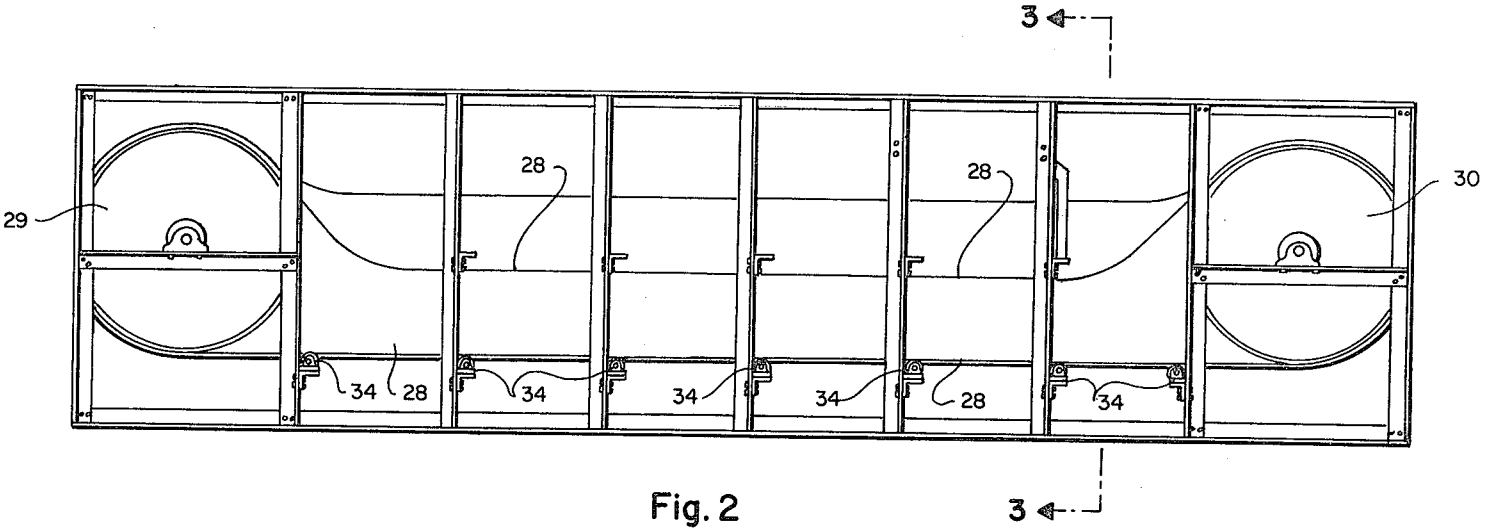
FIG. 2 is an elevational, side view of a belt conveyor which can be used in separating the solution of solvent and bituminous material from the particulate sands.
Figure 4:
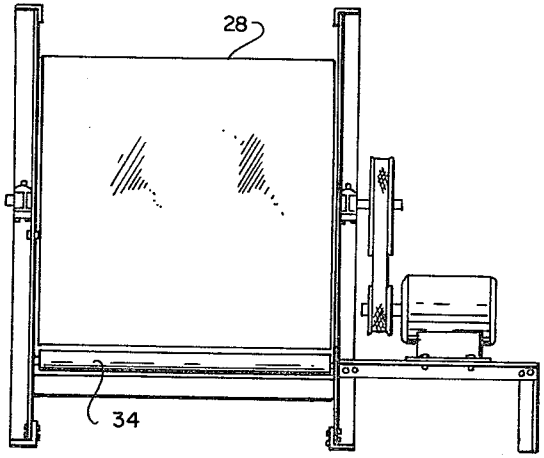
FIG. 4 is an end view of the belt conveyor of FIG. 2.
Figure 3:
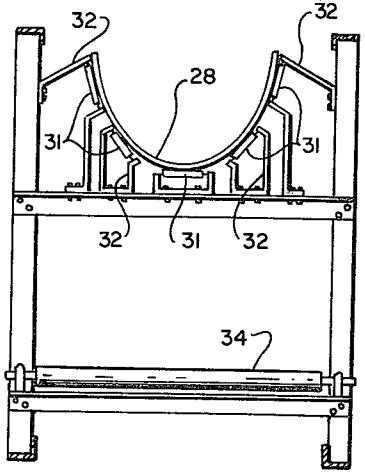
FIG. 3 is a cross-sectional view taken on line 3—3 of FIG. 2.

A preferred embodiment of a belt conveyor apparatus which can be employed in place of the drag line conveyor of FIG. 1, is illustrated in detail in FIGS. 2–4. The belt conveyor comprises an endless belt 28 which travels in an elongated circuitous loop around spaced apart drums 29 and 30 which rotate about a substantially horizontal axis. An upper bearing assembly supports the upper portion of the belt 28 as it travels from the upper side of one drum 29 to the upper side of the other drum 30. The upper bearing assembly comprises spaced apart sets of roller bearings. Each set of roller bearings comprises a plurality of rollers 31 as shown in FIG. 3 which are positioned so as to form the upper portion of the belt into a substantially deep "V" trough as it passes from drum 29 to drum 30. As shown, the sets of roller bearings are supported on vertical support members 32 spaced along the length of the belt 28 between the drums 29 and 30. The belt 28 forms flat ends of the trough as it passes over the respective drums 29 and 30.

A body of water is maintained in the trough formed by the upper portion of the belt 28, and the slurry of sand and organic solvent from the mixing vessel is fed to the trough near or adjacent to drum 29 through an appropriate feed chute (not shown) which extends beneath the surface of the water. The particulate sands which are deposited on the belt 28 with the slurry moves on the belt 28 from the one drum 29 adjacent to the feed chute 32 to the other drum 30. As the particulate sands moves through the body of water the solvent phase containing the dissolved bituminous material forms a separate phase beneath the water on the belt 28. The particulate sands move upwardly through the surface of the body of water as the belt 28 passes around the upper portion of the drum 30. The sands, which are wetted by water but not by the organic solvent finally falls from the belt 28 as the belt 28 continues its movement around drum 30, with the sands being disposed of or recovered for further use as a clear sand aggregate or or further treatment to recover mineral values therefrom. The organic phase comprising the solvent and bituminous material is continuously withdrawn from beneath the body of water in the trough formed by the belt 28. A plurality of spaced, flat rollers 34 are provided to support the lower portion of the belt 28 as it passes from drum 30 back to drum 29.

Figure 5:
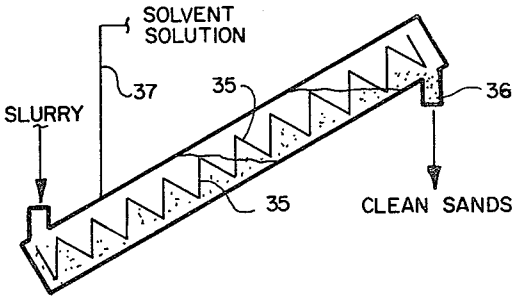
FIG. 5 is a schematic representation of another type conveyor which can be used in the process in place of the belt conveyor.

A third embodiment of conveyor apparatus which can be employed in place of the drag line conveyor or the belt conveyor is shown schematically in FIG. 5. The conveyor shown in FIG. 5 comprises an auger or screw 35 which is mounted within a housing and the unit is inclined. The slurry from the mixing vessel is introduced near the bottom end of the auger or screw 35, and a body of water is maintained in the housing so as to submerge at least the greater portion of the auger or screw 35. As the aurger or screw rotates, it moves the particulate sands upwardly through the body of water, and the organic solvent solution separates from the sands and forms a separate phase beneath the body of water. The cleaned, water wetted sands are ejected from a port 36 in the upper end of the housing above the body of water therein. The organic phase containing the solvent and bituminous material is withdrawn from a port 37, the bottom end of the housing and below the body of water therein.

A particularly preferred embodiment of the solvent flashing and condensing system of this invention is shown in FIGS. 6–9. The flash evaporation chamber 24 is positioned side-by-side of the condenser chamber 26. Means are provided for introducing the solvent solution into the evaporator chamber 24. As illustrated, a plurality of spray nozzles 40 are provided in to top portion of the evaporator chamber 24, with the spray nozzles 40 being connected to a manifold which in turn is connected to a supply port in the evaporator chamber through which the solvent solution is supplied to the manifold. Positioned just above the spray nozzles 40 is a mist elimination mechanism 41 which collects and coalesces small droplets of liquid. The mist eliminator 41 comprises a mesh grid as is well known in the art. Above the mist eliminator 41 is a large port for withdrawing solvent vapors from the evaporator chamber. This port is connected by a conduit 42 to the intake of a compressor 25. As will be described hereinafter, heat exchange means are provided below the spray nozzles 40 in the evaporator chamber 24 for providing heat necessary to flash the solvent from the solution being sprayed into the evaporator chamber 24.

The compressor 25 compresses the solvent vapors and the compressed vapors are transferred through conduit 43 to an inlet port in the top of the condenser chamber 26. The vapor compressor 25 can be any of the type used in large commercial refrigeration systems. The compressed vapors contact heat exchange means in the condenser chamber 26 which cool the vapors so that the vapors condense.

The heat exchange means associated with the condenser chamber 26 and the evaporator chamber 24 comprises at least one elongate, sealed container, such as a conduit or pipe 44 which has one end thereof positioned within the flash evaporator chamber 24 and the other end thereof positioned within the condenser chamber 26. A heat exchange medium, comprising any of the commercially available refrigerants, is charged into the sealed conduit 44 to form a working fluid therein having a liquid phase in equilibrium with its vapor phase within the conduit 44.

Figure 9:
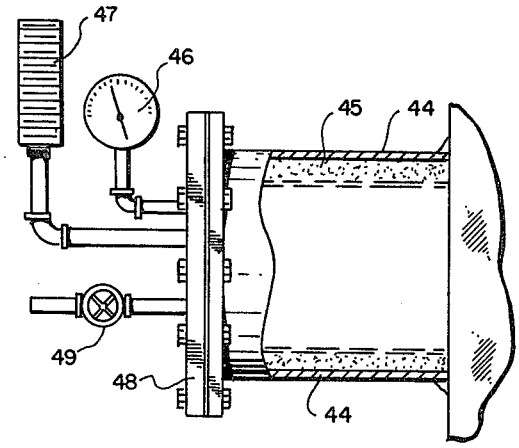
FIG. 9 is an enlarged cross-sectional through one of the heat pipes taken on line 9—9 of FIG. 6.

Means are provided for moving the liquid phase of the working fluid from the end of the conduit 44 positioned within the evaporator chamber 24 to the other end of the conduit positioned within the evaporator chamber 26, so as to cause the vapor phase of the working fluid to migrate generally from the end of the conduit 44 positioned within the flash evaporator chamber 24. In operation, the vapor phase of the working fluid absorbs heat in the portion of the conduit 44 positioned in the condenser chamber 26 and thus cool the condensing solvent vapors in the condenser chamber 26. The vapors of the working fluid then move to the portion of the conduit 44 positioned within the evaporator chamber 24, wherein heat is transferred to the solvent which is being flashed from the solution of bituminous organic material and solvent being sprayed into the evaporator chamber 24. The working fluid condenses in the portion of the conduit 44 positioned within the evaporator chamber, and means are provided for moving the liquid phase to the portion of the conduit 44 positioned within the condenser chamber 26. A capillary wick structure is advantageously used on the inner surface of the conduit 44 at least as a portion of the means for moving the liquid phase of working from the evaporator chamber 24 to the condenser chamber 26. The capillary structure may be comprised of grooves formed on the inner surface of the conduit 44, or as shown in FIG. 9, a layer of wire or fabric mesh 45 is positioned around the inner surface of the conduit. As shown, a temperature gauge 46 and pressure gauge 47 can be installed through the end flange 48 of the conduit 44 to measure the working parameters within the conduit 44 and changing of the working fluid thereto. In addition to the capillary structure, the conduits 44 are preferably slanted at least slightly so that the end portions thereof positioned within the evaporator chamber 24 is higher than the corresponding end portions positioned within the condenser chamber 26, whereby the working fluid will move from the higher ends under the force of gravity.

The organic bituminous material from which the solvent has flashed in the evaporator chamber 24 accumulates at the bottom of the evaporator chamber 24 and is withdrawn through a pump 50. An auxiliary heating means can be positioned near the bottom of the evaporator chamber 24 to maintain the organic bituminous material at a temperature at which it can be pumped to storage or packaging facilities. The auxiliary heating means can be a conventional tube and shell heat exchanger 51 (FIGS. 6 and 7) which uses hot water or low pressure steam.

Figure 6:
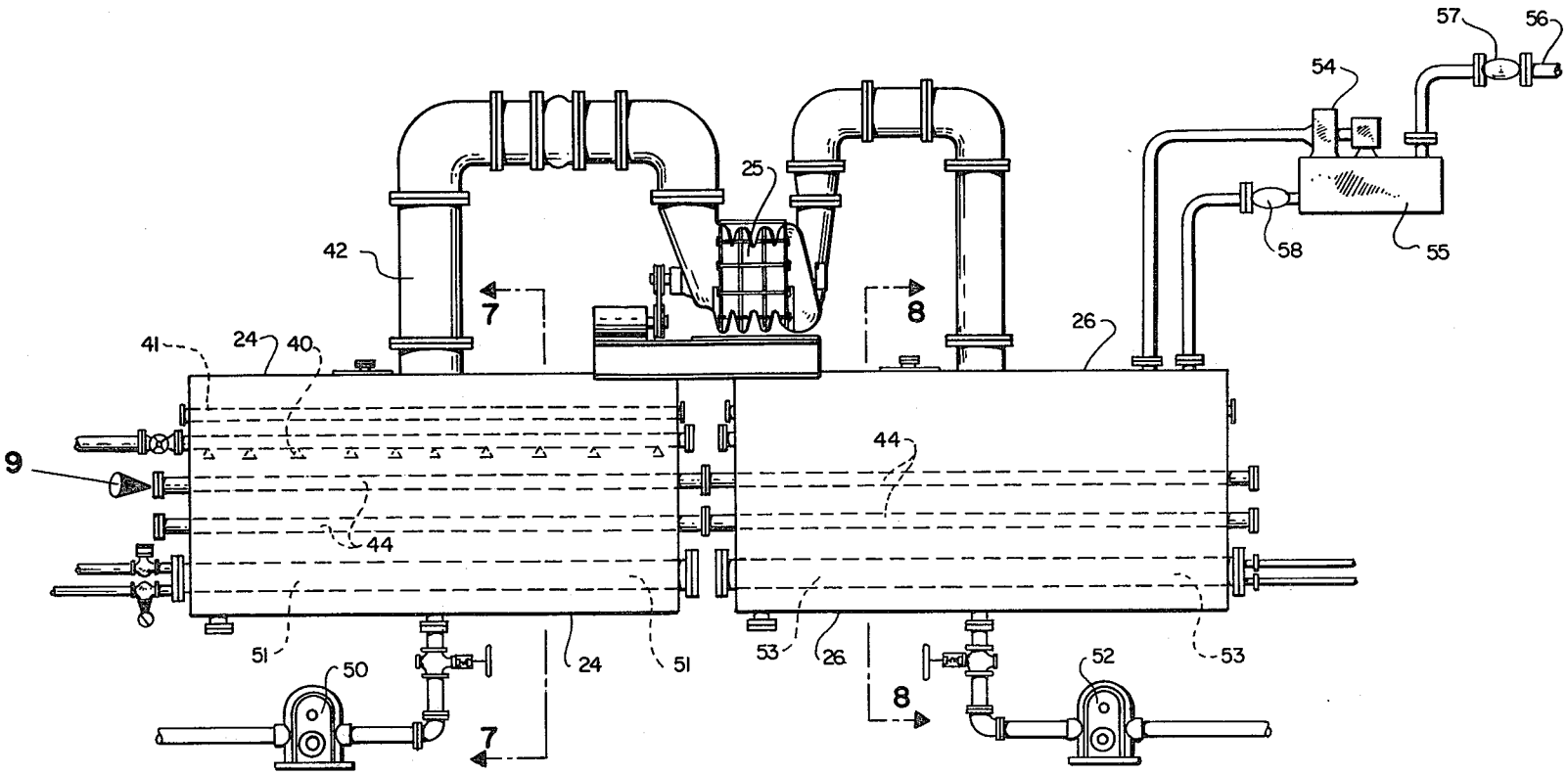
FIG. 6 is an elevational, side view of a preferred embodiment of the solvent flashing and condensing system of this invention.
Figure 7:
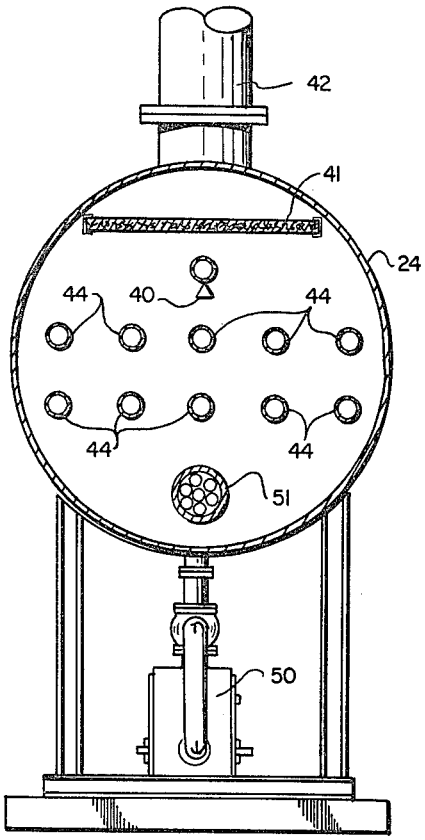
FIG. 7 is a cross-sectional view through the flash evaporator chamber taken on line 7—7 of FIG. 6.
Figure 8:
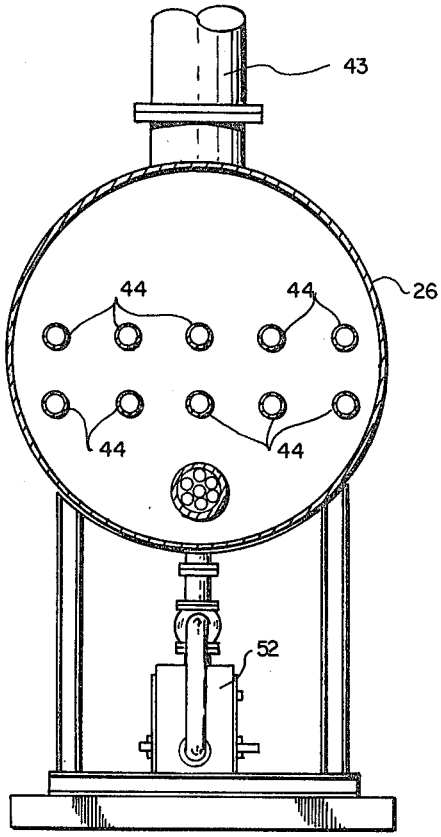
FIG. 8 is a cross-sectional view through the condenser chamber taken on line 8—8 of FIG. 6.

The condensed solvent accumulates in the condenser chamber 26 and is withdrawn by pump 52 for recycle as described hereinabove. An auxiliary heat exchange means can be positioned within the condenser to cool the condensate. A conventional tube and shell heat exchanger 53 (FIGS. 6 and 8) can be used, with the heat exchange medium being a liquid such as chilled water. Means for removing noncondensibles from the condenser chamber 26 can be provided as shown in FIG. 6. A high pressure compressor 54 withdraws the noncondensibles and some solvent vapors from the condenser chamber 26 and discharges the high pressure gases to a cooling chamber 55. The cooling chamber 55 has a conventional heat exchange means therein for cooling the high pressure gases, whereupon the condensable solvent vapors condense and are returned to the condenser chamber 26 as illustrated. Although not illustrated, the condensate from cooling chamber 55 can be recycled directly to the solvent holding tank 59 (FIG. 1). Non-condensibles are vented through a discharge conduit 56 and associated pressure responsive valve 57. The pressure responsive valve is adapted to maintain the desired pressure in the cooling chamber 55 as the noncondensibles are vented. A float valve 58 is associated with the conduit through which the condensate is withdrawn from the cooling chamber 55. The float valve 58 maintains a preset level of condensate in the cooling chamber 55 and thereby cooperates with the pressure responsive valve 57 in maintaining the desired pressure within the cooling chamber 55.

Whereas there are here illustrated and described embodiments of processes and apparatus presently contemplated as the best mode of carrying out the invention, it is to be understood that various changes may be made without departing from the subject matter coming within the scope of the following claims, which subject matter is regarded as the invention.

I claim:

1. A method of recovering bituminous organic material from oil or tar sands, comprising the steps of:

mixing the sands containing the bituminous organic material with a halogenated organic solvent which is substantially immiscible in water, has a density greater than that of water and is capable of dissolving the bituminous organic material contained in the sands, thereby producing a slurry of solid particles suspended in a solution of bituminous organic material dissolved in the halogenated organic solvent;

continuously feeding the slurry onto a conveyor system which is at least partially submerged in water, said slurry being fed onto the portion of the conveyor which is submerged in the water;

moving the particulate sands on the conveyor while submerged in the water whereby the solution of bituminous organic material dissolved in the halogenated organic solvent separates from the particulate sands and forms a separate organic phase beneath the water phase;

moving the particulate sands upwardly on the conveyor through the surface of the water so that the sand particles are wetted essentially only by water and contain essentially no organic solvent; and recovering the organic phase comprising the solution of bituminous organic material dissolved in the halogenated organic solvent from beneath the water phase.

2. A method in accordance with claim 1, wherein the mixing of the sands and the halogenated organic solvent is done beneath a water phase which is maintained over the organic solvent phase.

3. A method in accordance wiht claim 1, wherein the halogenated organic solvent is selected from the group consisting of methylene chloride, trichloromonofluoromethane, chloroform, carbon tetrachloride, bromotrichloromethane, dibromotetrafluoroethane, trichloroethane, trichloroethylene, tetrachloroethane, trichlorotrifluoroethane, dibromotetrafluoroethane, dichlorotrifluoroethane, and tetrachloroethylene.

4. A method in accordance with claim 1, wherein:

the conveyor comprises an endless belt conveyor which travels in an elongated circuitous loop around spaced apart drums which rotate about a substantially horizontal axis, with the portion of the belt which travels from the upper side of one drum to the upper side of the other drum being formed into a trough as it passes between the drums, and a body of water is maintained within the trough;

the slurry of sand and solution of bituminous organic material dissolved in the halogenated organic solvent is fed to the trough near or adjacent to said one drum and moves on the belt from said one drum to said other drum while submerged in the body of water which is maintained in said trough;

the particulate sands move upwardly through the surface of the body of water as the belt upon which the sand is being carried passes around the upper portion of said other drum, with the sands finally falling from the belt as the belt continues its movement around said other drum; and the organic phase which forms in said trough beneath the water is continuously removed from the trough.

5. A method in accordance with claim 1, wherein:

the conveyor comprises an inclined conveyor means enclosed by a housing, with a body of water maintained within the housing such that at least the major portion of the length of the conveyor is beneath the water;

the slurry of sand and solution of bituminous organic material dissolved in the halogenated organic solvent is fed into the housing near the bottom of the conveyor;

the solution of bituminous organic material dissolved in the halogneated organic solvent separates from the sand particles and forms an organic phase beneath the water phase in the housing;

particles of sand are moved upwardly through the body of water in the housing by the conveyor and are discharged fron the housing near the upper end of the conveyor; and the organic phase is continuously removed from beneath water phase in the housing.

6. A method in accordance with claim 1, wherein:

the organic phase recovered from beneath the water phase is introduced into a flash evaporator chamber;

vapors of the organic solvent are withdrawn from the evaporator chamber by a compressor which compresses the vapors;

the compressed vapors are introduced into a condenser chamber wherein the vapors are brought into heat exchanging relation with a heat exchange medium, whereby the vapors are condensed;

continuously circulating the heat exchange medium between the condenser chamber and the flash evaporator chamber, whereby heat is transferred from the heat exchange medium in the flash evaporator chamber to aid in the flash evaporation of the organic solvent therein and heat is transferred to the heat transfer medium in the condenser chamber by the condensing vapors therein; and bituminous organic material is withdrawn from the flash evaporator chamber, and the halogenated organic solvent is withdrawn from the condenser chamber.

7. A method in accordance with claim 6, wherein;

the heat exchange medium is contained in an elongate sealed container which has one end thereof positioned within the flash evaporator chamber and the other end thereof positioned within condenser chamber;

the heat exchange medium comprises a working fluid having a liquid phase in equilibrium with its vapor phase within the sealed container; and means are provided for moving the liquid phase of the working fluid from the end of said container positioned within the flash evaporator chamber to the other end of said container positioned within the condenser chamber, so as to cause the vapor phase of the working fluid to migrate generally from the end of said container positioned within the condenser chamber to the end thereof positioned within the flash evaporator chamber.

8. A method in accordance with claim 7, wherein the means for moving the liquid phase of the working fluid includes a capillary structure of grooves, layers of wire or cloth screens, or other system of capillaries capable of moving the liquid phase from the one end to the other end of the sealed, elongate container.

9. A method in accordance with claim 8, wherein the end of said container in the flash evaporator chamber is elevated with respect to the other end thereof so that gravity aids in moving the liquid phase of the working fluid in the container.

* * * * *